United States Patent [19]

Tanel

[11] Patent Number: 4,660,304

[45] **Date of Patent: * Apr. 28, 1987**

[54] ATHLETIC SHOE WITH IMPROVED PIVOT CLEATING

[75] Inventor: Michael L. Tanel, Milwaukee, Wis.

[73] Assignee: Tanel Corporation, Milwaukee, Wis.

[ * ] Notice: The portion of the term of this patent subsequent to Mar. 25, 2003 has been disclaimed.

[21] Appl. No.: 800,740

[22] Filed: Nov. 22, 1985

Related U.S. Application Data

[63] Continuation-in-part of Ser. No. 565,746, Dec. 27, 1983, Pat. No. 4,577,422.

[51] Int. Cl.[4] ..... A43B 5/00; A43B 5/02

[52] U.S. Cl. ..... 36/126; 36/67 R; 36/134

[58] Field of Search ..... 36/126, 128, 134, 59 R, 36/59 C, 67 R, 67 A, 114, 132

[56] References Cited

U.S. PATENT DOCUMENTS

| | | | |
|---|---|---|---|
| 825,869 | 7/1906 | Sandeman | 36/132 |
| 844,057 | 2/1907 | Tillinghast | 36/132 |
| 1,736,576 | 11/1929 | Cable | 36/59 C |
| 2,365,027 | 12/1944 | Vrbany | 36/59 C |
| 2,677,905 | 5/1954 | Dye | 36/134 |
| 2,678,507 | 5/1954 | Dye | 36/134 |
| 3,271,885 | 9/1966 | McAuliffe | 36/134 |
| 3,466,763 | 9/1969 | Levin | 36/134 |
| 3,707,047 | 12/1972 | Nedwick | 36/134 |
| 4,347,674 | 9/1982 | George | 36/67 R |
| 4,569,142 | 2/1986 | Askinasi | 36/134 |

FOREIGN PATENT DOCUMENTS

| | | | |
|---|---|---|---|
| 866767 | 2/1953 | Fed. Rep. of Germany | 36/128 |

*Primary Examiner*—Henry S. Jaudon
*Assistant Examiner*—Steven N. Meyers
*Attorney, Agent, or Firm*—Peter N. Jansson

[57] ABSTRACT

An athletic shoe for field sports having a circular cleat formed on the sole in forward position substantially encompassing the ball-of-the-foot and toe portions of the sole, extending substantially across the width of the sole, and enclosing a surface coincident with the main surface of the sole. The shoe provides improved pivotability while also providing good traction, and can reduce the frequency of certain common leg injuries.

13 Claims, 10 Drawing Figures

ATHLETIC SHOE WITH IMPROVED PIVOT CLEATING

RELATED APPLICATION

This is a continuation-in-part of my copending U.S. patent application Ser. No. 565,746, now U.S. Pat. No. 4,577,422 filed Dec. 27, 1983, entitled ATHLETIC SHOE WITH IMPROVED PIVOT CLEATING.

FIELD OF THE INVENTION

This invention is related generally to athletic shoes of the type having cleats, such as football shoes, and, more specifically, to athletic shoes with cleating facilitating pivoting movements.

BACKGROUND OF THE INVENTION

Most athletic shoes used for field sports, such as football, baseball, softball, soccer, and lacrosse, have a number of tapered or blade-like cleats for the purpose of increasing traction. Cleats dig into the turf to prevent slipping during starting, stopping, and cutting maneuvers.

Such cleats, however, in addition to providing desirable traction for starting, stopping and cutting, typically provide very undesirable resistance to pivoting. This can be a disadvantage in two ways.

When pivoting is inhibited, the maneuverability of the athlete is limited. His performance is less than it could be. Enhancing the ability of a player to pivot can greatly increase his effectiveness on the field.

In addition to inhibiting certain pivoting actions which athletes attempt or would like to attempt, many cleats of the prior art tend to resist turning movements which can relieve stresses within the leg when unwanted torque or force is applied to the athlete, particularly to a leg. If a twisting moment is forcibly applied to a leg at a time when the cleats are firmly planted into the turf and release from the turf is not possible, injuries can result, particularly common knee injuries.

Some athletic shoes have cleats intended to accommodate pivoting movements. One approach has used fixed annular cleats: The performance of such shoes can vary greatly, depending on various factors. However, the annular-cleated athletic shoe of the aforementioned copending patent application provides greatly improved pivotability and unexcelled traction, and reduces the chance of athletic injuries.

The improvement in pivotability of shoes made under the principals of such copending patent application is dramatic, and such shoes give the athletes wearing them a natural feeling of freedom together with a good feeling of traction for stopping, starting and cutting.

The invention described and claimed herein relates generally to athletic shoes having continuous annular cleats. The athletic shoes of this invention have continuous annular cleats which are modified to provide particular advantages.

In some cases, modifications in the continuous ring can improve or change the performance in desirable ways, ways to suit the wearer or provide the right "feel" to the athlete.

For example, while good pivotability may be highly desirable, it may be desirable to control the degree of pivotability without eliminating the ability of the shoe to turn while firmly planted in order to avoid knee injury. Having means to provide some resistance to turning would be highly desirable.

Also, annular cleats because of their structural characteristics can tend to reduce sole flexibility to some extent. Having a high degree of sole flexibility is desirable because it gives the shoes a natural feeling, allowing the normal bending of the sole of the foot to be expressed through the sole of the shoe. Furthermore, it is believed that sole inflexibility can tend to be a negative factor with respect to sole wear characteristics, causing undue pressures at certain points in the sole. Having means to improve the degree of sole flexibility would be highly desirable.

This invention is directed toward such improvements in cleated shoes having substantially continuous annular cleats.

Before describing the invention, a brief description of the foot and its pivoting and planted positions will be helpful. This can serve as an aid in understanding preferred embodiments of this invention.

The sole of the foot includes four basic portions. These are, in order back to front: the heel portion; the arch portion; the ball-of-the-foot portion; and the top portion. The heel portion and the ball-of-the-foot portion are those portions which share most if not all of the player's weight when the player is in a normal standing position with his feet generally flat on the ground. In such position, the arch portion bears little if any weight, and the toe portion bears little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position the juncture of the phalanges (toe bones) and the metatarsles is the center of weight bearing. In other words, the center of weight bearing in the forward portions of the foot actually moves forward when a player shifts to the ready position.

The sole of an athletic shoe has portions immediately below such four foot portions which may be designated, and herein are designated, by the same terms.

BRIEF SUMMARY OF THE INVENTION

This invention is an improved athletic shoe for field sports providing excellent controlled pivotability and traction, and good sole flexibility.

The sole of the athletic shoe of this invention includes a substantially continuous annular cleat encompassing a major area of the ball-of-the-foot and toe portions of such sole, extending across the width of the sole, and terminating in a distal edge, which is preferably circular. Such annular cleat, while substantially continuous, includes one or more breaks along the distal edge which may serve several purposes, including those described above.

The breaks may be in various shapes, including notches, slots and slits of various kinds. Notches are V-shaped cutouts which are widest at the distal edge. Slots are breaks having parallel walls which are preferably normal to the main sole surface. Thin slots, or slits, are one preferred form of breaks. In a particularly preferred form, the breaks extend from the distal edge of the annular cleat substantially to the main sole surface.

The breaks are minor interruptions or discontinuities in the annular cleats, such that the cleats remain substantially continuous. The breaks serve to provide some control on pivotability and/or to increase the bending flexibility of the sole.

The form, number and placement of the breaks determine their functions. More and wider breaks will retard pivotability to a greater extent than fewer and narrower breaks. Likewise, breaks tend to increase bending flexibility, if only by a minor amount. Slits, which are very narrow breaks, will increase flexibility as much as wider breaks, but will have very little controlling effect on pivotability. Breaks extending all the way to the main sole surface tend to increase flexibility more than breaks which are not that deep.

In highly preferred embodiments, there are a pair of breaks in the annular cleat, one at each intersection of the cleat with a chord extending at substantially right angles across the sole. Such a pair of breaks facilitates bending of the sole at the chord line. There may be more than one pair of breaks, each pair along a different chord line across the sole.

In such embodiments, when the breaks are parallel-walled slots, the slot walls may also be parallel to the chord lines. This is a preferred way to facilitate bending of the sole.

The annular cleat preferably is centered about the portion of the sole beneath the juncture of the phalanges and the metatarcles, that is, at the junction of the ball-of-the-foot and toe portions of the sole. All non-cleat areas of the sole area enclosed by such annular cleat are preferably coincident with the main sole surface; that is, such surfaces are not built up. This allows full turf penetration by the annular cleat or cleats.

In some preferred embodiments, the circular cleat is the forwardmost cleat on the shoe. In some embodiments, a central cleat, preferably of the standard tapered frustoconical shape, is disposed concentrically within the circular cleat.

In some embodiments, one or more additional annular cleats are disposed concentrically within the principal annular cleat. There may be breaks in some or all of such concentric annular cleats. The breaks may be at each intersection of a chord line with the concentric cleats for greatest sole flexibility, or breaks may be in offset arrangement.

OBJECTS OF THE INVENTION

It is an object of this invention to provide an improved pivoting athletic shoe.

Another object of this invention is to provide a pivoting athletic shoe having good pivotability which is controlled.

Another object of this invention is to provide a pivoting athletic shoe which has good sole flexibility to improve its comfort and performance.

Yet another object of this invention is to provide an improved athletic shoe which controls pivoting while reducing the the risk of injuries, such as knee injuries.

Another object of this invention is to provide an athletic shoe having superior pivotability and improved traction.

These and other objects will be apparent from the following additional descriptions, including the drawings wherein:

DETAILED DESCRIPTION OF PREFERRED EMBODIMENTS

Figure 1:
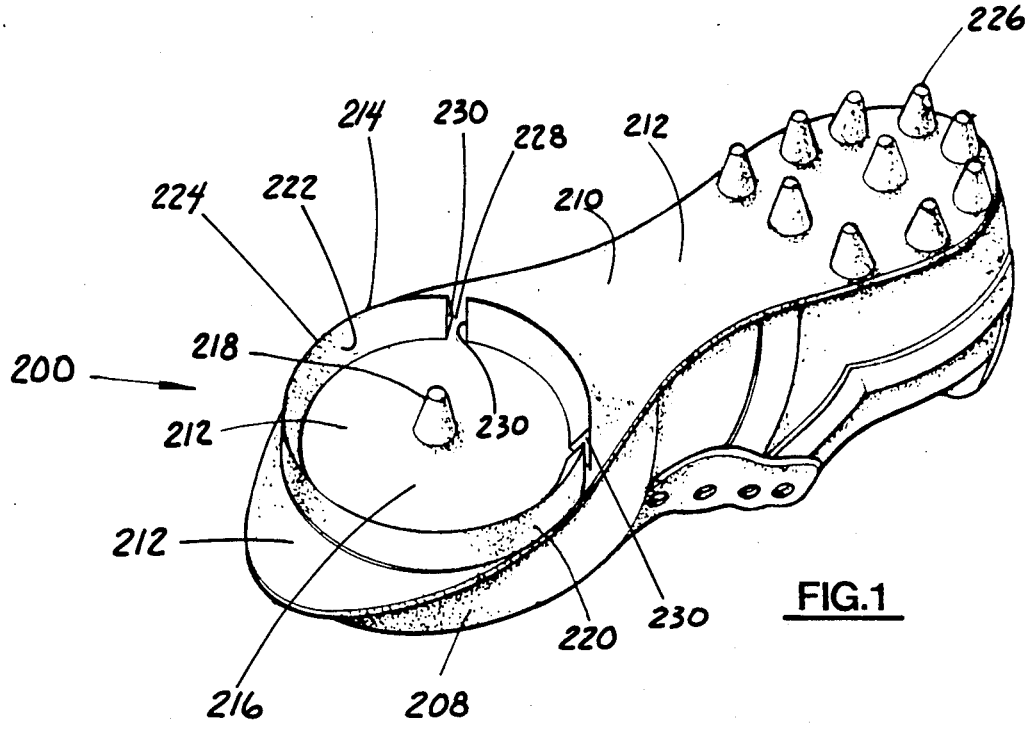
FIG. 1 is a sole-up perspective view of a preferred athletic shoe in accordance with this invention.
Figure 10:
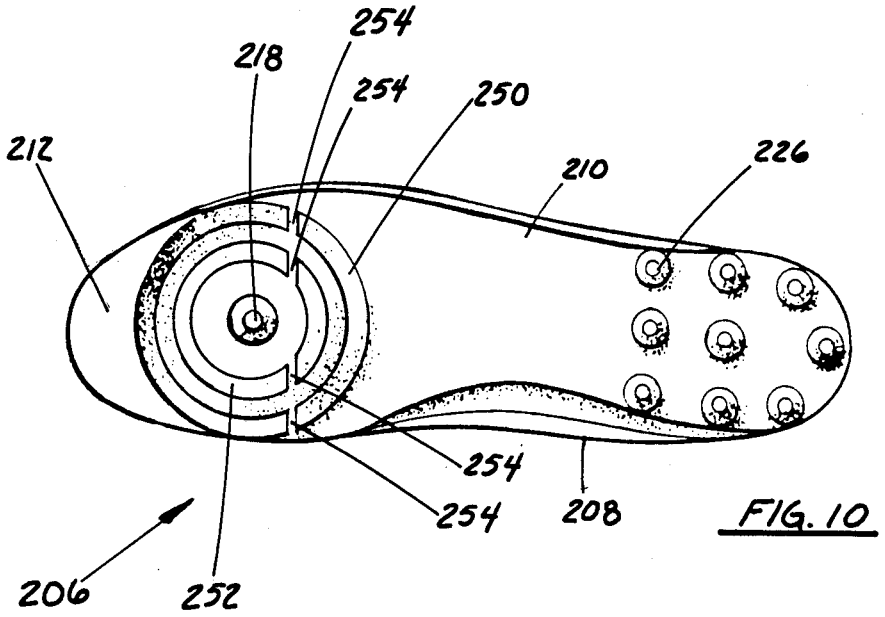
FIG. 10 is a plan view of the sole of another alternate embodiment.
Figure 2:
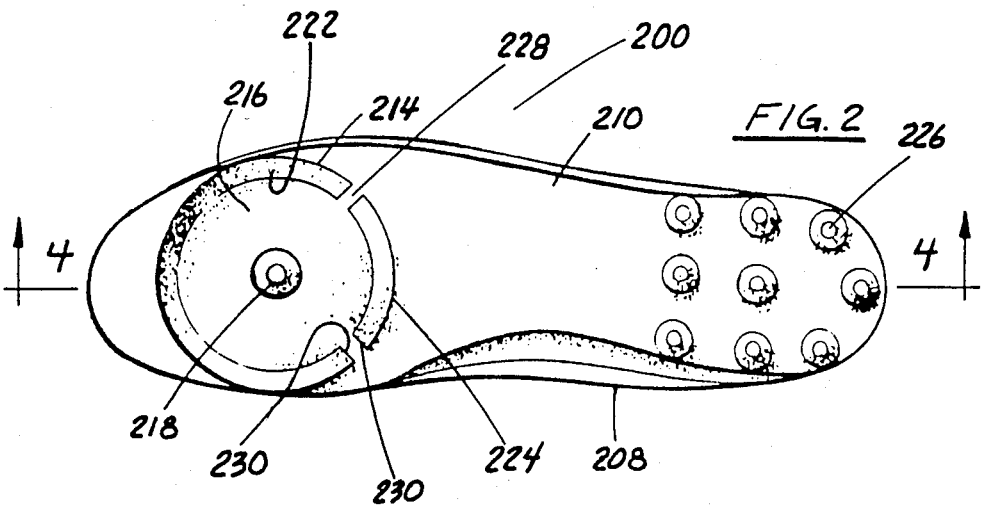
FIG. 2 is a plan view of the sole of the shoe FIG. 1.
Figure 4:
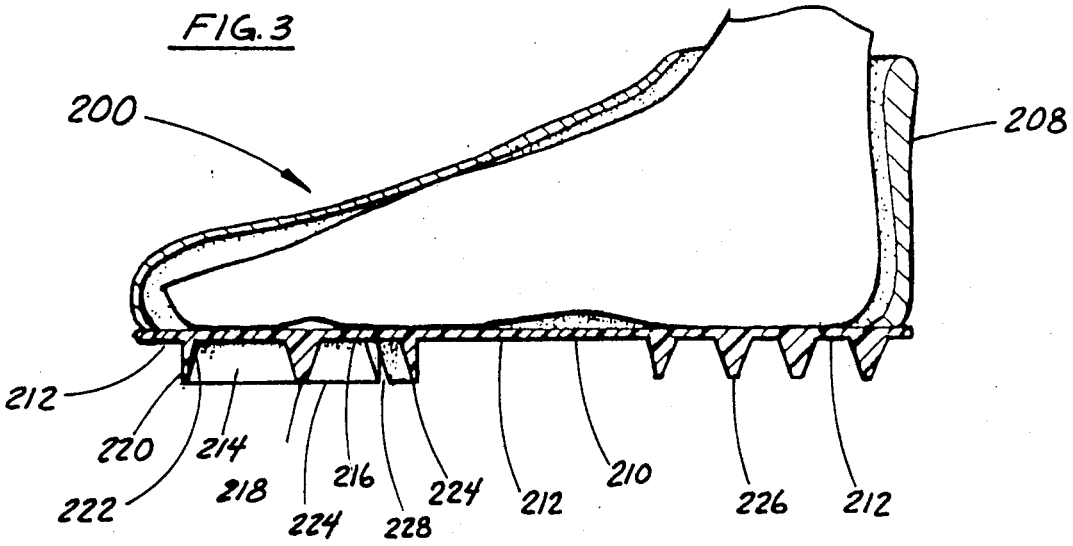
FIG. 4 is a sole-down sectional view, taken along section 4—4 as shown in FIG. 2, including a player's foot.
Figure 5:
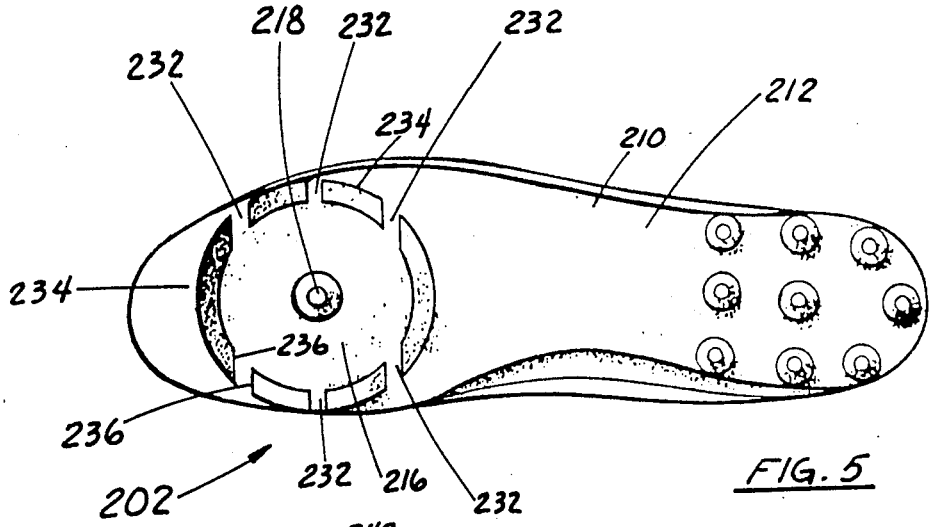
FIG. 5 is a plan view of the sole of an alternate embodiment.
Figure 6:
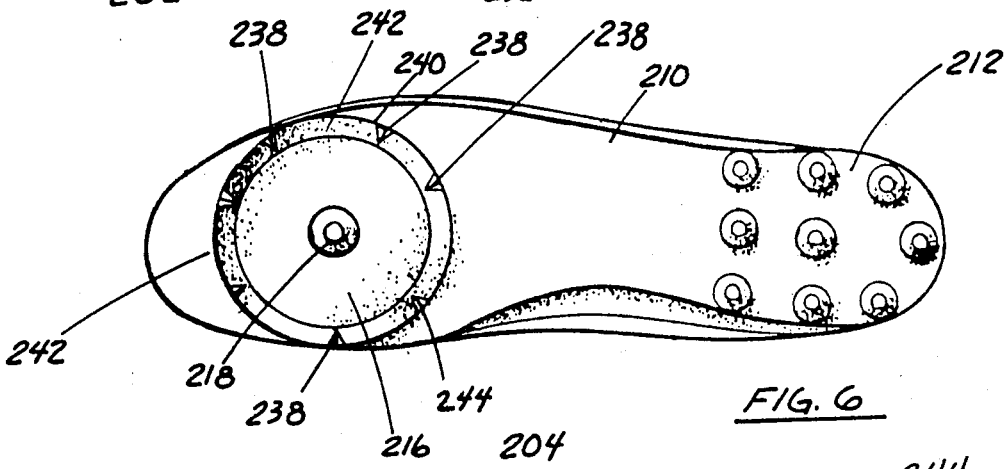
FIG. 6 is a plan view of the sole of still another alternate embodiment.

FIGS. 1, 2 and 4 illustrate a preferred athletic shoe 200 in accordance with this invention. FIGS. 5, 6 and 10 illustrate other preferred embodiments 202, 204 and 206 respectively. In such embodiments, like parts will be identified by the same numbers.

Shoe 200 has a upper 208 and a sole 210 affixed together in the normal way. The make-up of upper 208 is not a part of this invention, and upper 208 may be made of conventional materials such as leather, canvass and the like. Sole 210 is made of material which is tough and wear-resistant but which can flex in the normal manner depending on how weight is applied to it. Sole 210 is preferably formed of polyurethane or rubber.

The lower surface of sole 210, which contacts the surface of the playing field, includes a main sole surface 212, which is a generally flat even surface, and cleats project therefrom. The cleats are preferably integrally formed with main sole surface 212 in a molding process.

Figure 3:
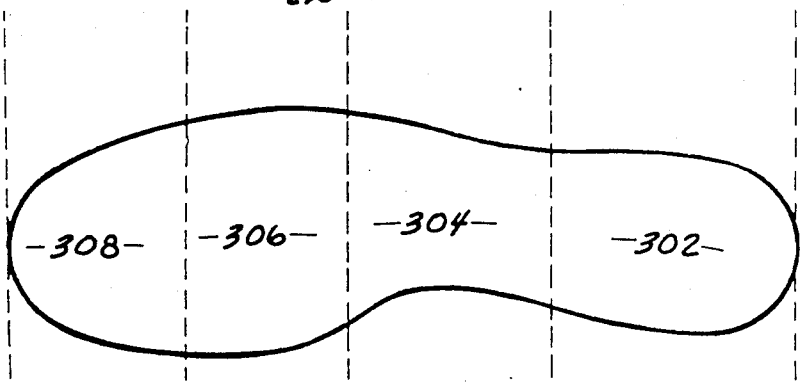
FIG. 3 is a cleatless schematic plan view of an athletic shoe sole, illustrating the portions thereof.

As illustrated in schematic FIG. 3 and in FIG. 4 which are aligned with each other, the sole has four portions which are defined by the portions of the foot adjacent to them. These sole portions are: a heel portion 302, immediately below the player's heel; an arch portion 304, below the arch of the player's foot; a ball-of-the-foot portion 306, below the ball of the player's foot; and a toe portion 308, below the player's toes.

As previsouly noted, the ball of the foot and the heel bear weight when the player is standing in a flat-footed stance, as in FIG. 4, while the toe and ball-of-the-foot portions bear weight when the player is in the ready position.

A substantially continuous annular cleat 214 projects from main sole surface 212. Annular cleat 214 is centered on the juncture of the ball-of-the-foot and toe portions 306 and 308, and extends across the width of sole 210. Annular cleat 214 encompasses a major area of ball-of-the-foot and toe portions 306 and 308, indeed, substantially the entire area of such portions. A standard frustoconical cleat is located at the center point of annular cleat 214. Annular cleat 214 encloses a sole area 216 all of which, except for center cleat 218, is coincident with main sole surface 212. That is, there are no built-up portions which can retard penetration of the playing surface by annular cleat 214 and center cleat 218. Sole area 216, however, may have texturing which may have some controlling effect on pivoting.

Annular cleat 214 has radially outward and inward annular surfaces 220 and 222 which converge to a circular distal edge 224. Outward surface 220 is normal (that is, perpendicular) to main sole surface 212. Inward surface 222 flares radially outwardly to converge with outward surface 220.

A number of standard frustoconical cleats 226 are formed on heel portion 302 of sole 210. A variety of cleats may be used on the heel of the shoe of this invention.

Along distal edges 224 are two breaks 228. Breaks 228 are in the form of notches having closely spaced parallel walls 230. Each of the breaks 230 extends from distal edge 224 to main sole surface 212. Walls 230 are substantially normal to main sole surface 212. The two breaks 228 are at the intersection of a chord line (not shown) with annular cleat 214. Such breaks 228 facilitate bending of sole 210 along such chord line. Breaks 228 are located on annular cleat 214 at a position where bending of sole 210 may not in some cases be desirable, although it is recognized that the main line of bending is at the juncture of arch portion 304 and ball-of-the-foot portion 306, which is located at the edge of annular cleat 214.

Athletic shoe 202, shown in FIG. 5, has three pairs of breaks 232, or a total of six breaks along its annular cleat 234. Each of these pairs of breaks are on a separate chord line extending across the sole of the shoe. This adds bending flexibility along three lines across annular cleat 234. Breaks 232 each have parallel walls 236. Parallel walls 236 are aligned parallel to parallel wall lines extending across the shoe. This alignment of breaks 232 tends to maximize the addition of flexibility to the shoe.

Shoe 204, illustrated in FIG. 6, has a different form of breaks than the previously described embodiments. A series of notches 238 are spaced around the distal edge 240 of annular cleat 242. Notches 238 are V-shaped cutouts which extend about half way from distal edge 240 to the main sole surface of the shoe. Such V-shaped notches are particularly useful in providing controlled pivotability.

Figure 7:
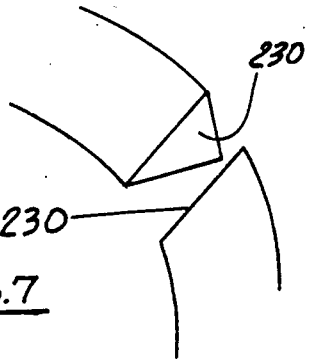
FIGS. 7–9 are enlarged fragmentary perspective views illustrating three types of breaks along the continuous annular cleats of this invention.
Figure 8:
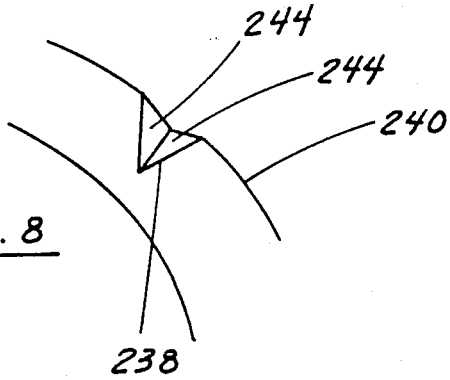
Figure 9:
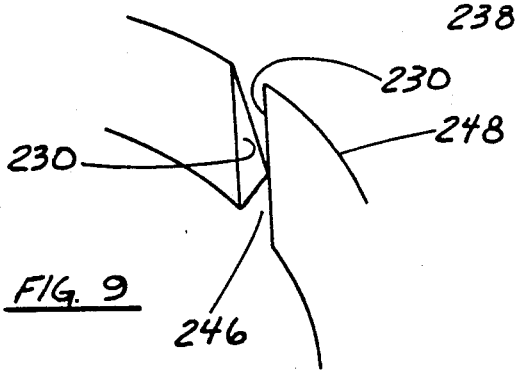

FIGS. 7–9 illustrate three different types of breaks. FIG. 7 shows a parallel-walled break 228, of the type previously described, having parallel walls 230. Walls are spaced apart by approximately one-quarter inch. Wider spacing for such breaks will tend to give greater resistance to pivotability. However, the breaks of this invention are all quite narrow, such that the annular cleats in which they are formed remain substantially continuous and provide the pivotability advantages previously discussed. FIG. 8 illustrates a notch 238 having converging notch walls 244. FIG. 9 illustrates a slit 246, which is an extremely narrow parallel-walled break generally of the type shown in FIG. 7. Slit breaks 246 contribute as much to pivotability as any other type of break, particularly if they extend all the way from distal edge 248 to the main sole surface. However, slit breaks 246 add minimum resistance to pivoting.

Shoe 206, illustrated in FIG. 10, has two annular cleats 250 and 252. Annular cleats 250 and 252 each have a pair of breaks 254 in them. All of the breaks 254 are along a single wall line extending across the sole of shoe 206. In some embodiments of this invention, there are a number of annular cleats having breaks in them. For example, in a shoe designed specifically for use on artificial turf there are several cleats of generally short height, and one or more of such annular cleats may have breaks in accordance with this invention.

While the principles of this invention have been described in connection with specific embodiments, it should be understood clearly that these descriptions are made only by way of example and are not intended to limit the scope of the invention.

What is claimed is:

1. In an athletic shoe of the type having a sole with a main sole surface and cleats extending therefrom to provide traction, such sole having heel, arch, ball-of-the-foot and toe portions, the improvement comprising:

a substantially continuous annular cleat encompassing a major area of the ball-of-the-foot and toe portions, centered substantially on the juncture of the ball-of-the-foot and toe portions, extending substantially across the entire width of the sole, and terminating in a substantially circular distal edge;

said annular cleat being flexible to allow flexing of the sole;

said annular cleat having inner and outer annular surfaces angled with respect to the main sole surface and extending to intersection with said main sole surface;

said annular cleat enclosing a sole area substantially all non-cleat portions of which are coincident with said main sole surface; and at least one break in said annular cleat along the distal edge, whereby both improved pivotability and traction are provided.

2. The athletic shoe of claim 1 wherein the break is a notch along the distal edge.

3. The athletic shoe of claim 1 wherein said break extends from the distal edge substantially to the main sole surface.

4. The athletic shoe of claim 3 wherein the break has walls which are substantially normal to the main sole surface.

5. The athletic shoe of claim 3 wherein the walls of such break are parallel.

6. The athletic shoe of claim 1 wherein there are at least two such breaks.

7. The athletic shoe of claim 1 wherein there are a pair of such breaks at the intersections of such cleat with a chord line extending across the sole, whereby bending of the sole at such line is facilitated.

8. The athletic shoe of claim 7 wherein there are at least two such pairs of breaks along at least two of such chord lines.

9. The athletic shoe of claim 7 wherein the breaks are notches along the distal edge.

10. The athletic shoe of claim 7 wherein said breaks extend from the distal edge substantially to the main sole surface.

11. The athletic shoe of claim 10 wherein the breaks have walls which are substantially normal to the main sole surface.

12. The athletic shoe of claim 10 wherein the walls of such breaks are parallel.

13. The athletic shoe of claim 12 wherein said breaks are slits.

* * * * *